US007784588B2

(12) United States Patent
SikShin et al.

(10) Patent No.: US 7,784,588 B2
(45) Date of Patent: Aug. 31, 2010

(54) CALLS ASSIGNED TO ONE OF TWO CARS IN A HOISTWAY TO MINIMIZE DELAY IMPOSED ON EITHER CAR

(75) Inventors: Cheong SikShin, Seoul (KR); Theresa Christy, West Hartford, CT (US); Arthur Hsu, Glastonbury, CT (US); Hansoo Shim, Seoul (KR); Harry Terry, Avon, CT (US)

(73) Assignee: Otis Elevator Company, Farmington, CT (US)

( * ) Notice: Subject to any disclaimer, the term of this patent is extended or adjusted under 35 U.S.C. 154(b) by 551 days.

(21) Appl. No.: 11/815,459

(22) PCT Filed: Feb. 4, 2005

(86) PCT No.: PCT/US2005/003145

§ 371 (c)(1),
(2), (4) Date: Aug. 3, 2007

(87) PCT Pub. No.: WO2006/085846

PCT Pub. Date: Aug. 17, 2006

(65) Prior Publication Data

US 2008/0087501 A1 Apr. 17, 2008

(51) Int. Cl.
*B66B 9/00* (2006.01)

(52) U.S. Cl. ..... 187/249; 187/382

(58) Field of Classification Search ..... 187/247, 187/248, 249, 380–388, 391
See application file for complete search history.

(56) References Cited

U.S. PATENT DOCUMENTS 849,840 A 4/1907 Foster
974,439 A 11/1910 Schwab
1,027,628 A 5/1912 Schwab
1,805,227 A 5/1931 Rugg
1,896,776 A 2/1933 James
1,896,777 A 2/1933 James
5,651,426 A 7/1997 Bittar et al.
5,663,538 A 9/1997 Sakita
5,752,585 A 5/1998 Bittar et al.
5,865,274 A 2/1999 Kiji et al.
5,877,462 A 3/1999 Clenais
6,273,217 B1 8/2001 Hikita
6,360,849 B1 3/2002 Hikita
6,364,065 B1 4/2002 Hikita (Continued)

FOREIGN PATENT DOCUMENTS

EP 1371596 A1 12/2003

(Continued)

*Primary Examiner*—Jonathan Salata
(74) *Attorney, Agent, or Firm*—Carlson, Gaskey & Olds PC

(57) ABSTRACT

A method of assigning destination calls to cars (A-F) in an elevator system (20) having a plurality of hoistways (21-23) in which there is more than one car in each hoistway includes determining (33) the time for each car to respond to the call Among the cars with an acceptable response time, a determination is made regarding (34) the amount of additional delay in the hoistway that assignment of the call to one car will impose on the either car in the same hoistway. The call is assigned to that car which creates the least additional delay for cars in any hoistway.

2 Claims, 2 Drawing Sheets

U.S. PATENT DOCUMENTS

| | | | | |
|---|---|---|---|---|
| 6,394,231 | B1 | 5/2002 | Schuster et al. | |
| 6,554,107 | B2 | 4/2003 | Yumura et al. | |
| 7,032,716 | B2 | 4/2006 | Meyle et al. | |
| 7,117,979 | B2 | 10/2006 | Angst et al. | |
| 7,178,635 | B2 | 2/2007 | Meissner et al. | |
| 7,392,884 | B2 * | 7/2008 | Hikita | 187/249 |
| 2005/0082121 | A1 | 4/2005 | Deplazes | |
| 2005/0087402 | A1 | 4/2005 | Haegi et al. | |
| 2005/0279584 | A1 | 12/2005 | Ruter et al. | |
| 2006/0289240 | A1 | 12/2006 | Sakita | |
| 2007/0039785 | A1 | 2/2007 | Smith et al. | |

FOREIGN PATENT DOCUMENTS

| | | | |
|---|---|---|---|
| EP | 1698580 | A1 | 9/2006 |
| JP | 4345486 | | 12/1992 |
| JP | 4361960 | | 12/1992 |
| JP | 5051185 | | 3/1993 |
| JP | 5132257 | | 5/1993 |
| JP | 6305648 | | 11/1994 |
| JP | 8133611 | | 5/1995 |
| JP | 7157243 | | 6/1995 |
| JP | 7172716 | | 7/1995 |
| JP | 8133630 | | 5/1996 |
| JP | 9110316 | | 4/1997 |
| JP | 2001226050 | | 8/2001 |
| JP | 2001240318 | | 9/2001 |
| JP | 2001247265 | | 9/2001 |
| JP | 2001251188 | | 9/2001 |
| JP | 2001335244 | | 12/2001 |
| JP | 2002220164 | | 8/2002 |
| JP | 2002255460 | | 9/2002 |
| JP | 2003160283 | | 6/2003 |
| JP | 2004155519 | | 6/2004 |

* cited by examiner

CALLS ASSIGNED TO ONE OF TWO CARS IN A HOISTWAY TO MINIMIZE DELAY IMPOSED ON EITHER CAR

TECHNICAL FIELD

This invention relates to an elevator system in which there is at least two cars in each hoistway, the assignment of calls to the cars including mitigation of delay imposed on either car in the hoistway while it waits for the completion of service by another car in the same hoistway.

BACKGROUND ART

The utilization of two or more elevator cars in a single hoistway provides increased elevator service capacity in contrast with traditional, single car-per-hoistway service. However, it is inevitable that either car may need to travel too closely to another car for safety, or need to travel to a point at or beyond the current position of the other car. The capacity of the elevator system is reduced whenever one of the cars is sitting idle due to the necessity for it to wait for another one of the cars to finish providing passenger service and thereafter remove itself from impeding the travel of the first one of the cars. Either car can become the one that is sitting idle, waiting for the other.

DISCLOSURE OF INVENTION

Objects of the invention include: reducing waiting time of idle cars in a hoistway having at least two cars serving passengers; improving the service capacity of an elevator system having at least two cars in a single hoistway; and improved multi-car-per-hoistway elevator service.

According to the present invention, in an elevator system in which there is more than one car in each hoistway, a factor in determining the car to which each destination call will be assigned is the amount of additional delay that the assigned car may cause to either car in the same hoistway, calls being assigned to mitigate delay imposed by one car on another, not only in the same hoistway, but among multiple hoistways serving the same elevator stops.

According to the invention in one form, those cars which have an acceptable response time to a destination call are considered as candidates to answer the call, the call being assigned to the one which will impose the least delay on either car in the same hoistway, thereby to minimize delays of cars imposed by service requirements of other cars in the same hoistway.

Additional delay is defined herein as the difference between the time that a car will normally complete its service of passengers and be able to resume additional service, such as by returning to the lobby or changing direction to service calls along the way, and the time at which it may resume other service after the other car in the hoistway is no longer in the way. The additional delay is based mainly on the times that each car in the same hoistway will complete servicing its assigned calls, with and without either car having a new call assigned to it. The delay also takes into account the number of floors of separation required between the cars for car position and car motion safety considerations.

Other objects, features and advantages of the present invention will become more apparent in the light of the following detailed description of exemplary embodiments thereof, as illustrated in the accompanying drawing.

MODE(S) FOR CARRYING OUT THE INVENTION

Figure 1:
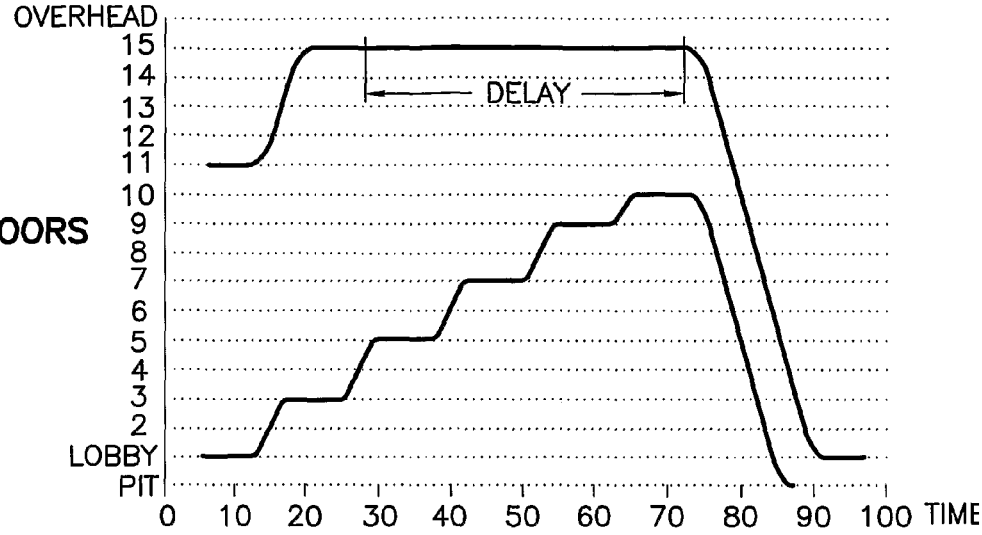
FIG. 1 is a time chart of two cars serving a plurality of floors in a building, in which the upper car is delayed a long time waiting for the lower car to complete its service.
Figure 2:
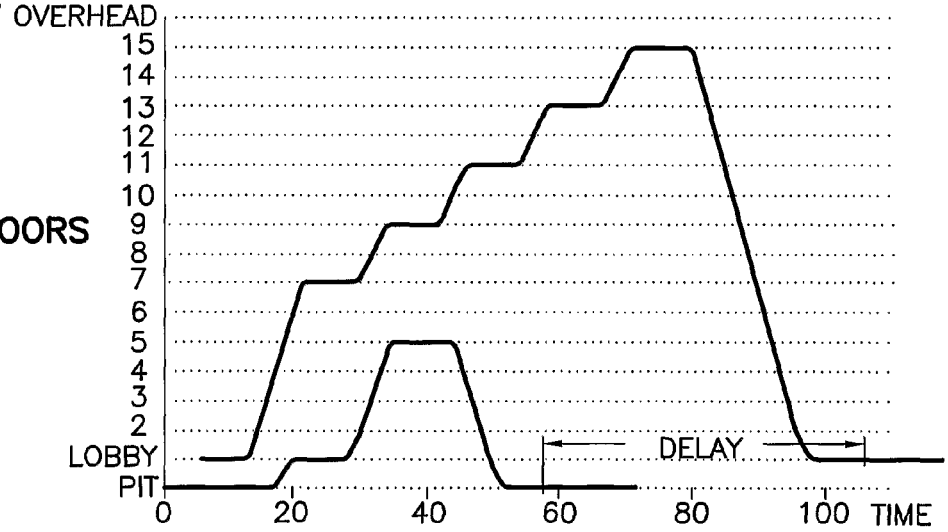
FIG. 2 is a time chart of a pair of cars serving a plurality of floors in a building in which a lower car is delayed a long time waiting for the upper car to complete its service.
Figure 3:
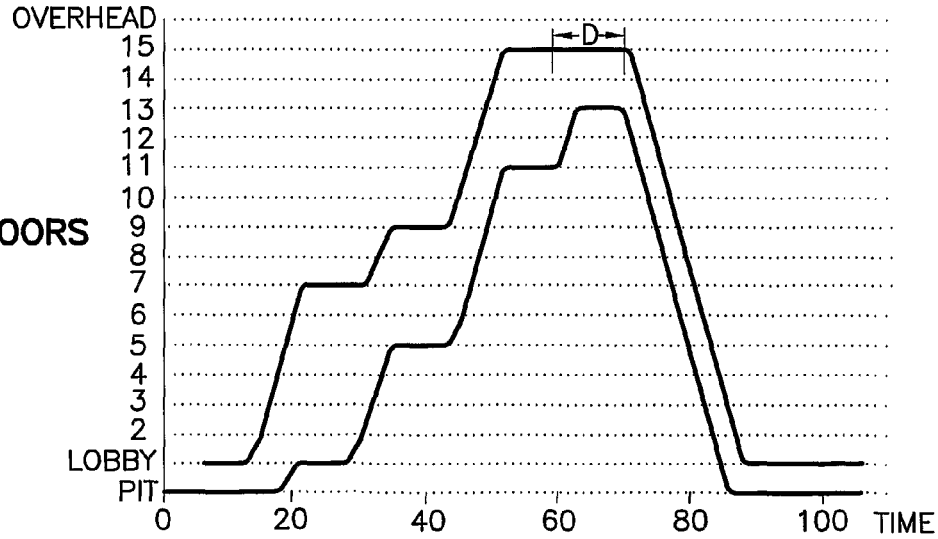
FIG. 3 is a time chart of a pair of cars serving a plurality of floors in a building in which the assignment of calls to the two cars reduces the delay of the upper car imposed by waiting for the lower car to complete its service.

Situations in which one car causes unnecessary delay of the other car, due to the extent of passenger service being performed by the first car, are illustrated in FIGS. 1-3. Referring to FIG. 1, an upper elevator executes only one call, delivering a passenger from the $11^{th}$ floor to the $15^{th}$ floor. A lower elevator in the same hoistway responds to a number of calls, beginning at the lobby and ending at the $10^{th}$ floor. Since the upper car cannot return to the lobby until the lower car finishes its service and travels downwardly, there is an extensive delay of about 50 seconds in which the upper car is idle.

In FIG. 2, the reverse is true: the lower car executes only one call from the lobby to the fifth floor and, such as during up-peak, has no further calls and is returned to the pit (one floor below the lobby where it is out of the way of the upper car). The lower car then cannot resume service for a long delay period, until the upper car completes service, returns to the lobby to pick up more passengers and travels upwardly to be out of the way of the lower car.

Assume in FIG. 2 that the stop on the $11^{th}$ floor is to pick up a passenger to be delivered to the $13^{th}$ floor. This means that the upper car has a total of five stops. In accordance with the invention as illustrated in FIG. 3, even though there is a slightly longer waiting time for the passenger to be picked up on the $11^{th}$ floor, that call is assigned to the lower car which delivers the passenger from the $11^{th}$ floor to the $13^{th}$ floor. In this situation, both cars make only three stops. It is seen that the delay, D, is much shorter in this instance.

Figure 4:
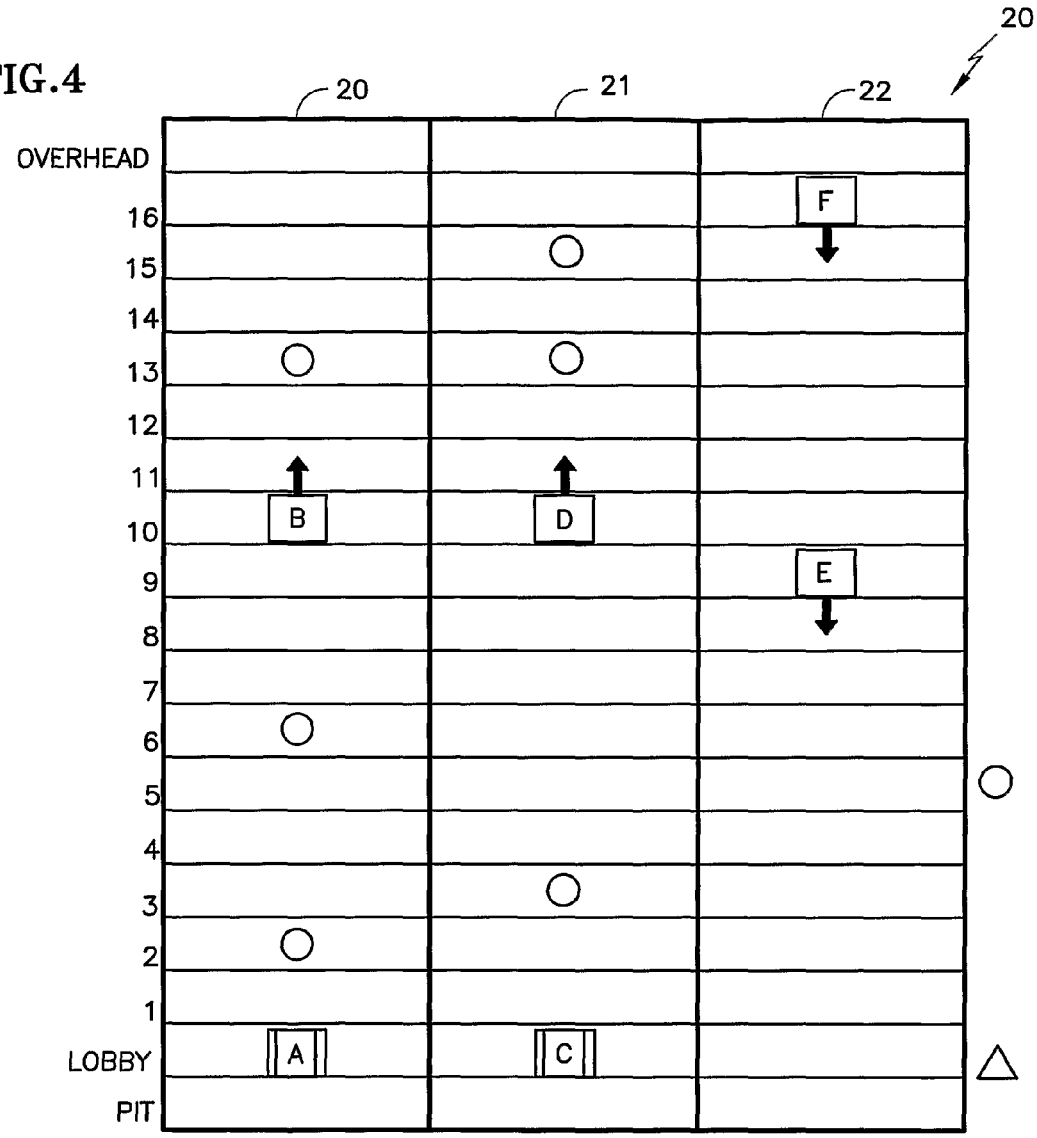
FIG. 4 is a stylized front elevation view of a three-hoistway elevator system, each hoistway having a pair of cars, illustrating principles of the invention.

Another situation in which the invention reduces delay time of an elevator system 20 is illustrated among a plurality of hoistways 21-23 in FIG. 4. Therein, car A has calls with destinations (indicated by circles) on the second and sixth floors. Car B has a call with a destination on the $13^{th}$ floor. Car C has a call with a destination on the third floor. Car D has calls with destinations on the $13^{th}$ and $15^{th}$ floors. Cars E and F are headed downwardly toward the pit and the lobby, respectively.

Assume now a call is entered (represented by the triangle) with a destination on the fifth floor (represented by the circle above the triangle). A determination of the response time for each of the cars to answer that call indicates that cars B, D, E and F have too long a response time, so the assignment of the call should be to either car A or car C. Either car A or car C could, in the normal course of events, deliver the passenger who has entered the call for the fifth floor at substantially the same time; however, in accordance with the invention, assigning the call to car A will cause car B to have to wait after it delivers its passenger to the $13^{th}$ floor, while car A completes servicing three calls. On the other hand, assigning the fifth floor call to car C will cause car C and car D to complete their service at substantially the same time, thereby substantially eliminating any delay of one car caused by the other car. Therefore, the new call for the fifth floor is assigned to car C in accordance with the invention.

Figure 5:
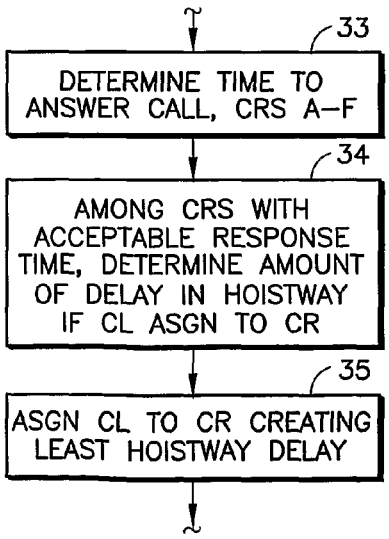
FIG. 5 is a chart illustrating functions of the invention.

The operational strategy of the present invention is illustrated briefly in FIG. 5. Therein, a first function 33 of the process determines, in a conventional fashion, the response time for each of the cars A-F to respond to the new call. The second function 34 of the process determines, among those cars with acceptable response times, the amount of delay caused to one car in a hoistway if the call is assigned to another car in that same hoistway. The final function 35 of the operational strategy of the invention assigns the call to the car that creates the least additional hoistway delay as a function of the call assignment, as is described hereinbefore with respect to FIGS. 3 and 4.

The invention claimed is:

1. A method of assigning destination calls to elevator cars in an elevator system having at least two cars in each hoistway, said method comprising:

determining a time required for each car in said system to respond to each call that is registered;

among those cars having an acceptable response time to a call, assigning the call to the one of the cars which will provide the least additional delay, for either car in any hoistway, the additional delay being an amount of time between when a considered elevator car has completed serving the calls currently assigned to the considered elevator car and a time when the considered elevator car is able to respond to a subsequent call, and to mitigate a time in which one car is waiting for the other car in the same hoistway to be out of the path of a traveling requirement of said one car.

2. A method of assigning calls to elevator cars serving a plurality of floors of a building having a plurality of elevator hoistways, at least two cars arranged for traveling in each hoistway, said method comprising:

determining a time required for each said car to respond to each registered call;

determining, for each car having an acceptable response time, an amount of additional delay that will be imposed on said car or the other car in the same hoistway with said car, if the call is assigned to said car, the additional delay being an amount of time between when said car has completed serving the calls currently assigned to said car and a time when said car is able to respond to a subsequent call; and assigning the call to the car that will result in the least additional delay to any of said cars.

* * * * *